US012595033B2

(12) United States Patent
Angelini et al.

(10) Patent No.: US 12,595,033 B2
(45) Date of Patent: Apr. 7, 2026

(54) PRESSURE-REDUCING SYSTEM FOR A BREATHING APPARATUS

(71) Applicant: MARES S.P.A., Rapallo (IT)

(72) Inventors: Sergio Angelini, Lavagna (IT); Gabriele Canella, Rapallo (IT); Valerio Palmieri, Rapallo (IT)

(73) Assignee: HEAD WATERSPORTS S.P.A., Rapallo (IT)

( * ) Notice: Subject to any disclaimer, the term of this patent is extended or adjusted under 35 U.S.C. 154(b) by 576 days.

(21) Appl. No.: 18/169,912

(22) Filed: Feb. 16, 2023

(65) Prior Publication Data

US 2023/0278683 A1 Sep. 7, 2023

(30) Foreign Application Priority Data

Mar. 2, 2022 (IT) ..... 102022000003899
Jan. 24, 2023 (EP) ..... 23153097

(51) Int. Cl.
*B63C 11/22* (2006.01)

(52) U.S. Cl.
CPC ..... *B63C 11/2227* (2013.01)

(58) Field of Classification Search
CPC . B63C 11/2227; B63C 11/22; B63C 11/2236; B63C 11/20; B63C 11/202; B63C 11/18; B63C 11/14; B63C 11/12; B63C 11/02; A62B 9/00; A62B 9/02; A62B 9/022; A62B 18/10
See application file for complete search history.

(56) References Cited

U.S. PATENT DOCUMENTS 3,329,158 A * 7/1967 Geiszler ..... B63C 11/2236 251/282
4,002,166 A 1/1977 Oliver
4,041,978 A 8/1977 Leemann
5,222,490 A * 6/1993 Pomerantz ..... B63C 11/2227 128/205.24

(Continued)

FOREIGN PATENT DOCUMENTS

EP 0534741 A1 3/1993

OTHER PUBLICATIONS

Search report and Written Opinion for IT202200003899, dated Sep. 27, 2022.

*Primary Examiner* — Colin W Stuart
(74) *Attorney, Agent, or Firm* — Chrisman Gallo Tochtrop LLC

(57) ABSTRACT

A pressure-reducing system for a breathing apparatus including: i) a supply conduit for supplying a pressurised breathable gas; ii) a suction mouthpiece for a user to breathe in the breathable gas; and iii) a valve operatively interposed between the supply conduit and the suction mouthpiece. The valve includes: —an inlet, —an outlet; —a shutter permits or prevents the passage of the breathable gas from the inlet to the outlet; and—a pressure balancing chamber, the shutter being interposed between the inlet of the valve and the balancing chamber; the shutter defining a conduit that places the inlet of the valve and the pressure balancing chamber in fluid communication. The pressure-reducing system further includes iv) a movement system for moving the pressure balancing chamber towards the inlet for the breathable gas to push the shutter from the first position to the second position.

14 Claims, 13 Drawing Sheets

(56) References Cited

U.S. PATENT DOCUMENTS

| | | | | | |
|---|---|---|---|---|---|
| 5,233,976 | A * | 8/1993 | Ferguson | B63C 11/2227 | 251/360 |
| 5,251,618 | A * | 10/1993 | Christianson | B63C 11/2227 | 128/205.24 |
| 5,259,375 | A * | 11/1993 | Schuler | B63C 11/2227 | 137/315.04 |
| 5,343,858 | A * | 9/1994 | Winefordner | B63C 11/2227 | 128/205.24 |
| 5,549,107 | A * | 8/1996 | Garraffe | A62B 9/02 | 128/205.24 |
| 5,660,502 | A * | 8/1997 | Ferguson | B63C 11/2227 | 405/186 |
| 5,678,541 | A * | 10/1997 | Garraffa | B63C 11/2227 | 128/205.24 |
| 5,690,100 | A * | 11/1997 | Pomerantz | A62B 9/02 | 128/205.24 |
| 5,803,073 | A * | 9/1998 | Toth | B63C 11/2227 | 128/205.24 |
| 7,171,980 | B2 | 2/2007 | Angelini et al. | | |
| 8,336,547 | B1 * | 12/2012 | Ritchie | A61M 16/0009 | 128/205.24 |
| 2004/0154669 | A1 * | 8/2004 | Semeia | B63C 11/2227 | 137/505.46 |
| 2005/0279410 | A1 | 12/2005 | Angelini et al. | | |
| 2008/0099018 | A1 * | 5/2008 | Clarke | A62B 9/022 | 128/204.26 |

* cited by examiner

PRESSURE-REDUCING SYSTEM FOR A BREATHING APPARATUS

The present invention relates to a pressure-reducing system for a breathing apparatus. It is typically used for diving applications, preferably in the second pressure reduction stage; more in general it could be employed in applications in which breathing takes place with the aid of a pressurised tank for accumulating a breathable gas (for example for moving around in underground environments or at the disposal of rescue teams that could find themselves operating in emergency zones).

There are known breathing systems that comprise a cylinder of a pressurised breathable gas, downstream of which a first pressure reduction stage is provided; downstream of the first stage, at the regulator, the second pressure reduction stage is provided. The first reduction stage allows the breathable fluid to be brought from the pressure of 280-300 bar which is found in the cylinder to an intermediate pressure of about 10 bar. The second stage further reduces the pressure, bringing it to the ambient value (a function of depth) so that the gas can be breathed in by the user.

A second stage is known, as described for example in patent application U.S. Pat. No. 4,002,166. In this case, located between the conduit supplying the pressurised breathable gas and the mouthpiece there is a valve comprising a shutter with a stem; a helical spring performs an action directly on the stem of the shutter to press it against an inlet hole of the valve and prevent the passage of the breathable gas towards the mouthpiece. Negative pressure induced by the user's breathing brings about a deformation of a diaphragm which in turn induces the shifting of a lever and the distancing of the shutter from the inlet hole (overcoming the action of the elastic spring). In this manner, the breathable gas flows in a zone surrounding the shutter stem and reaches the mouthpiece.

A solution is also known in which the stem has a central internal conduit that connects two opposite ends thereof. One of these ends faces the inlet of the valve and prevents/permits the passage of gas to the mouthpiece. The other end leads into and slides inside a pressure balancing chamber that is in a fixed position. The conduit thus allows the pressure in the balancing chamber to be balanced with the pressure at the valve inlet. Due to the ratios between the surfaces, the force exerted by the pressure in the balancing chamber only partly compensates for the force induced by the pressure at the valve inlet. The pressure present in the balancing chamber nonetheless helps the opposing spring to maintain the shutter in a position in which it prevents the passage of the breathable gas towards the mouthpiece. The above-described solutions are also known as "downstream valves". However, there is a drawback in that the presence of the spring makes a calibration and testing of the second stage necessary. This negatively impacts the costs of the product and the production speed.

Furthermore, an increase in the intermediate pressure (the pressure immediately upstream of the second stage) could causes bothersome venting.

A further solution of the type described in U.S. Pat. No. 7,171,980 is likewise known. In this solution the helical spring is absent, but the stem has a first and a second opposite ends and a central conduit connecting them. The first end is intended to prevent the passage of gas towards the mouthpiece whereas the second end leads into and slides inside a pressure balancing chamber that is in a fixed position. The conduit thus allows the pressure in the balancing chamber to be balanced with the pressure at the valve inlet. Since the second end has a larger pushing surface than the first end, during use there is normally present a force that pushes the shutter against the valve inlet. In this manner the passage of the breathable gas towards the mouthpiece is prevented. Negative pressure induced by the user's breathing allows the movement of a diaphragm, which in turn activates a lever that moves the shutter away from the valve inlet, thus enabling the supply of the breathable gas to the mouthpiece.

This type of solution is known in the technical field as "upstream valve". This solution, too, is not without drawbacks.

A first drawback is tied to the fact that, in the absence of intermediate pressure, there is no force acting upon the shutter, whose position is thus not defined when the system is depressurised. This implies two potential concerns. The first concern is tied to the fact that problems could occur at the time of rinsing the equipment after the dive. In fact, in a configuration in which the second stage is depressurised and the valve is open, carrying out a rinse after the dive would risk letting seawater pass through the valve of the second stage, causing it to arrive at the first stage. This is a situation to be avoided in view of the problems of corrosion associated with seawater. A second concern is tied to the fact that, if the valve is open, when the second stage is pressurised there is a risk that the shutter will never be able to shut off the supply. This is because the balancing chamber, in order to be able to exert its action, needs the gas to penetrate into it and pressurise it sufficiently. If the shutter were open, the gas supplied would continue to push the first end of the shutter, preventing it from moving near the closed position. Furthermore, a good part of the gas would flow outside the shutter towards the mouthpiece without being able to flow through the conduit inside the shutter in an amount capable of pressurising the balancing chamber sufficiently.

In this context, the technical task at the basis of the present invention is to propose a pressure-reducing system for a breathing apparatus that overcomes the abovementioned drawbacks of the prior art.

Furthermore, it is an object of the present invention to provide a pressure-reducing system for a breathing apparatus which is capable of facilitating assembly and maintenance.

A further object of the present invention is to propose a pressure-reducing system for a breathing apparatus which offers greater breathing comfort. The stated technical task and specified objects are substantially achieved by a pressure-reducing system for a breathing apparatus comprising the technical features disclosed in one or more of the accompanying claims.

Additional features and advantages of the present invention will become more apparent from the approximate, and thus non-limiting, description of a preferred but not exclusive embodiment of a pressure-reducing system for a breathing apparatus as illustrated in the accompanying drawings, in which.

Figure 8:
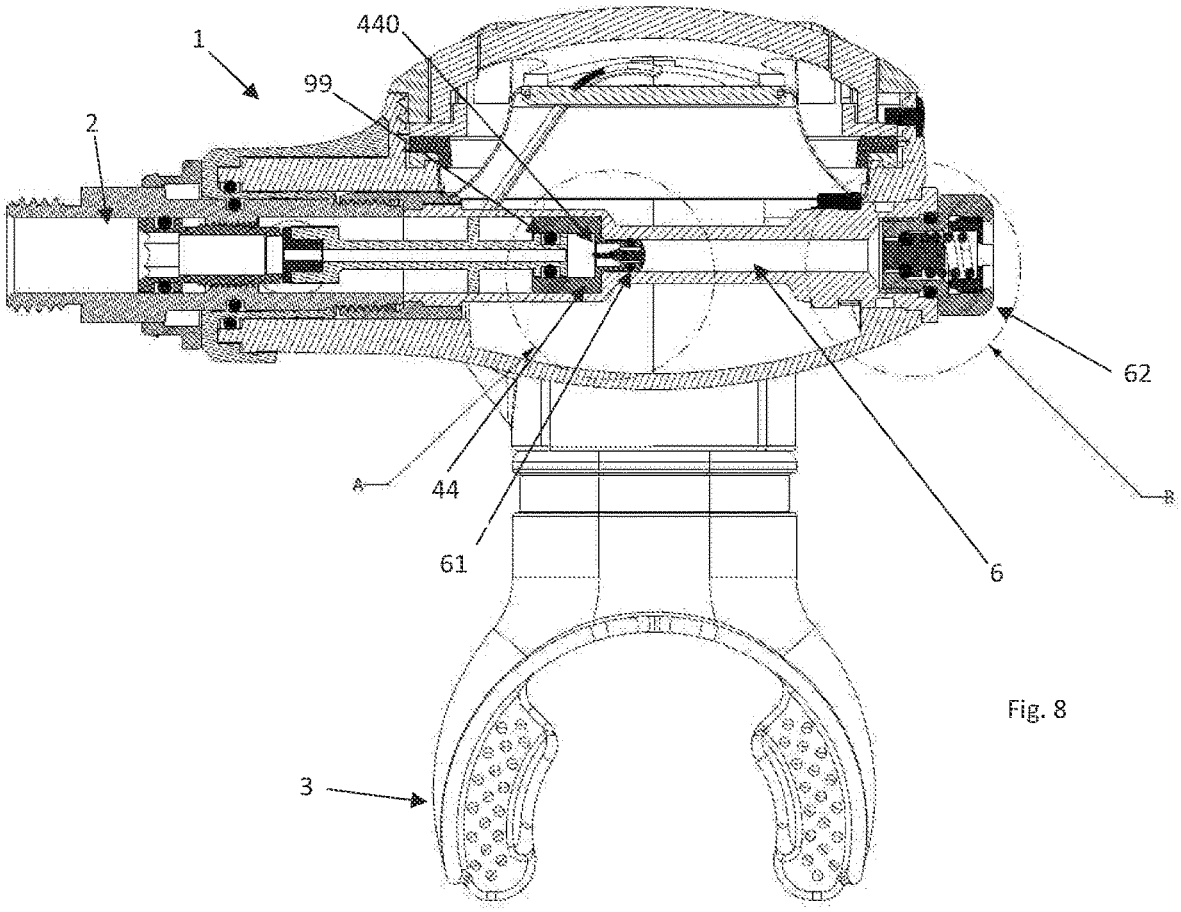
Figure 9:
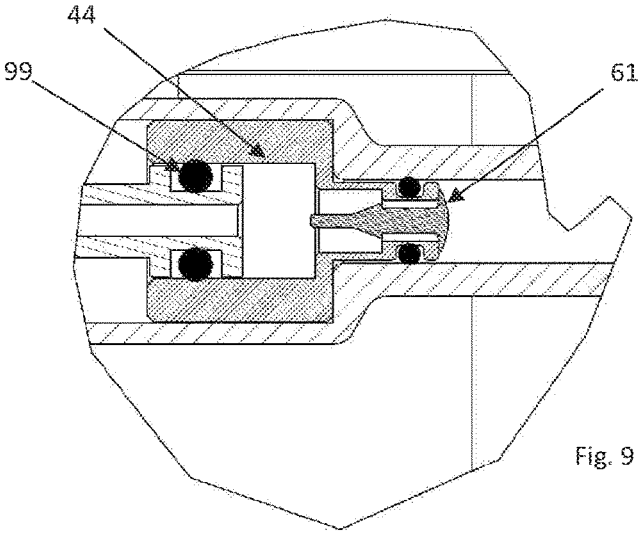
Figure 10:
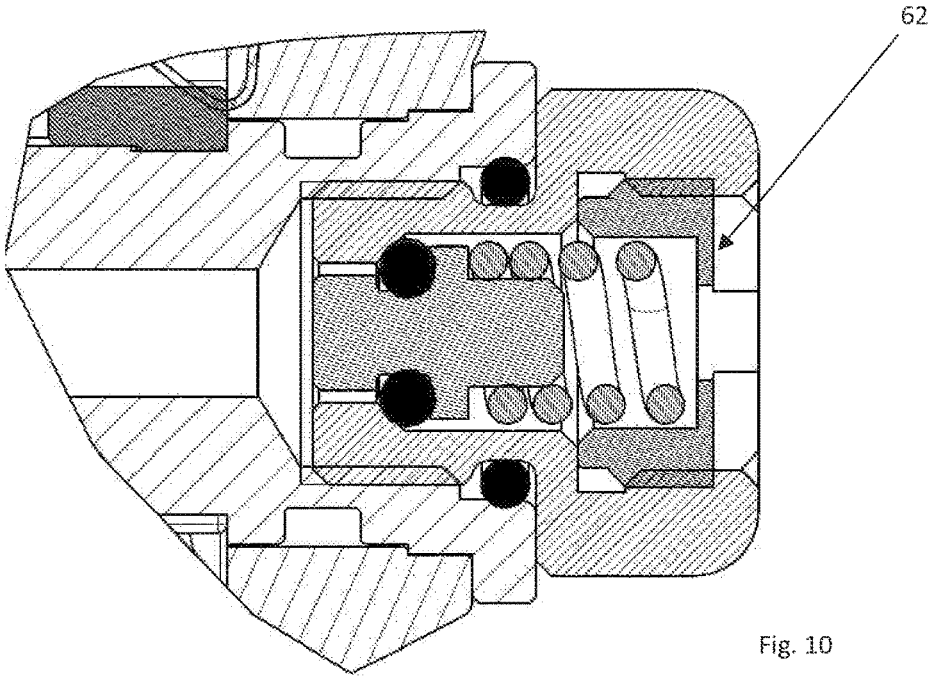
Figure 15:
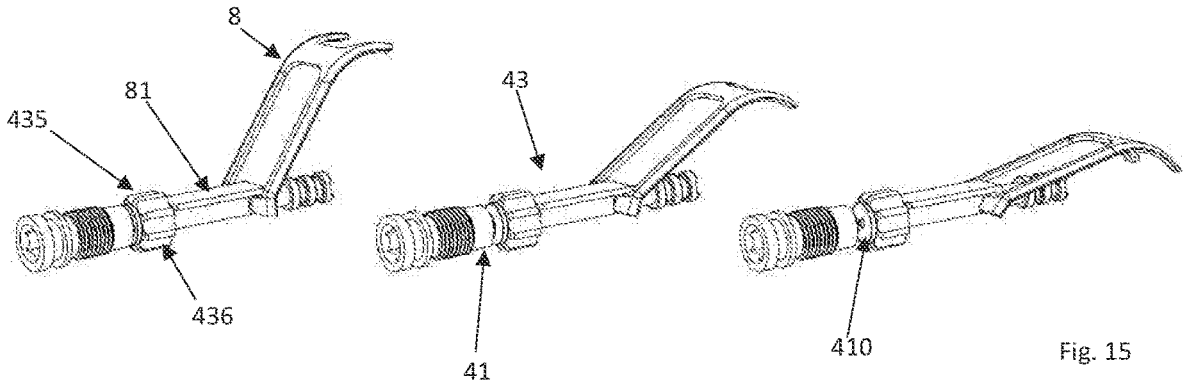
Figure 16:
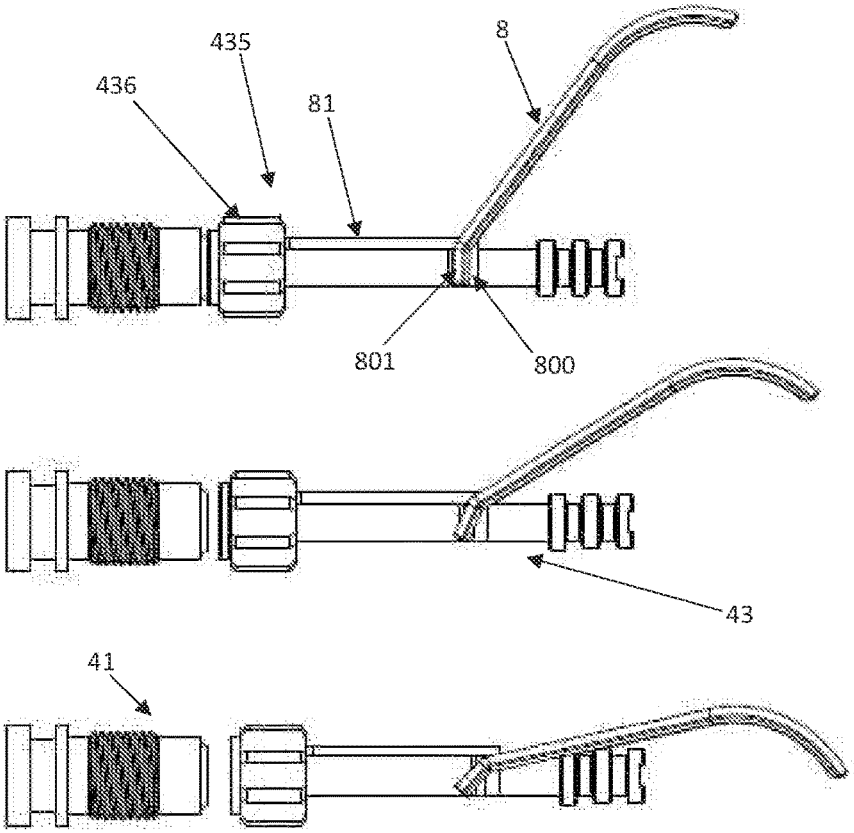
Figure 17:
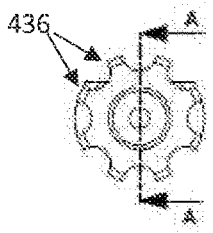
Figure 18:
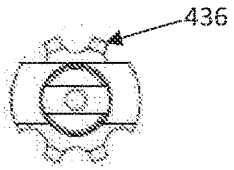
Figure 19:
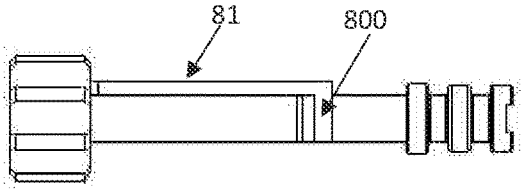
Figure 20:
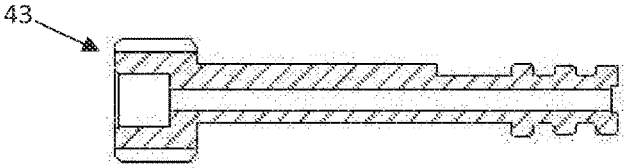
Figure 21:
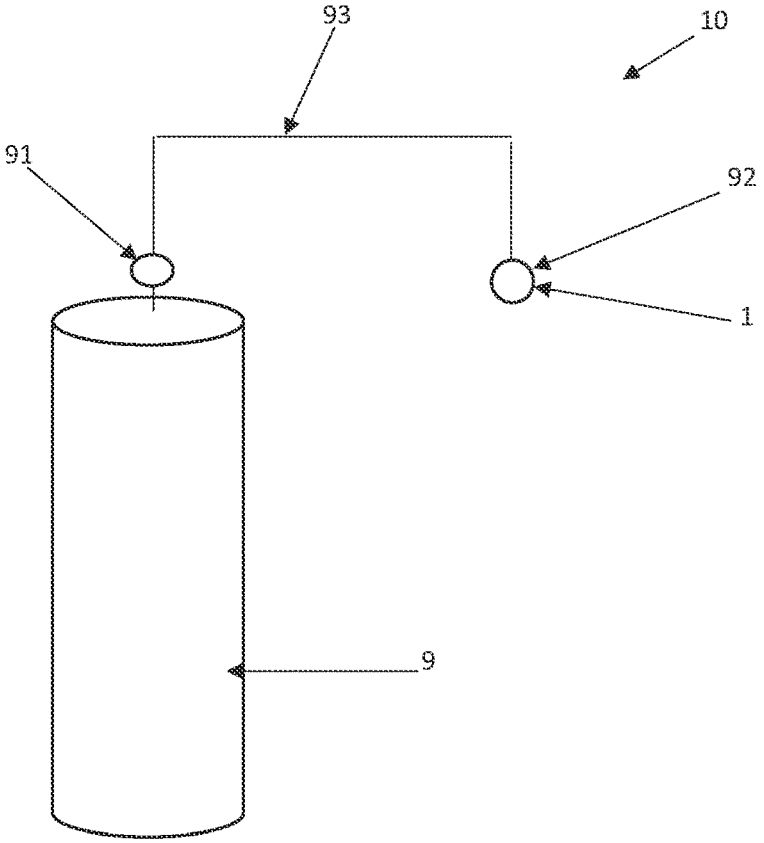
Figure 22:
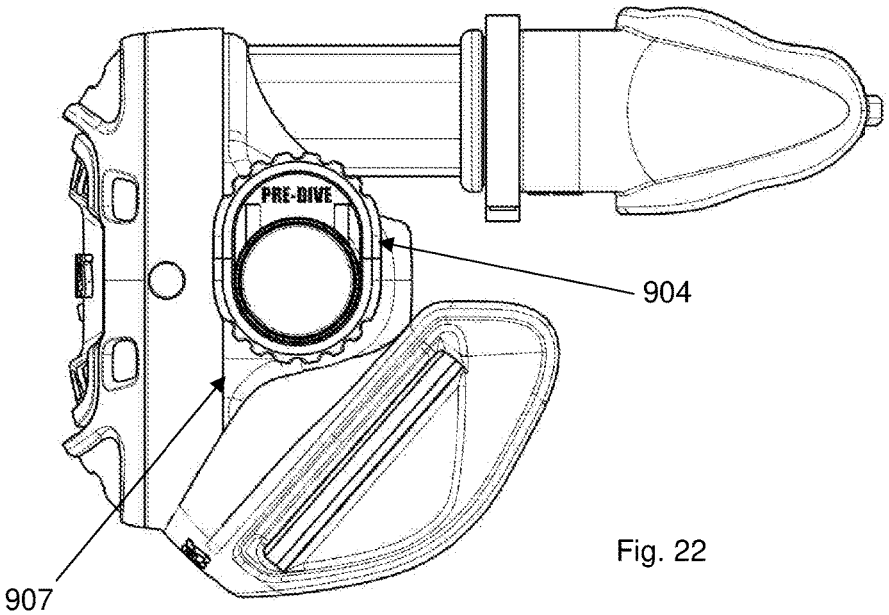
Figure 23:
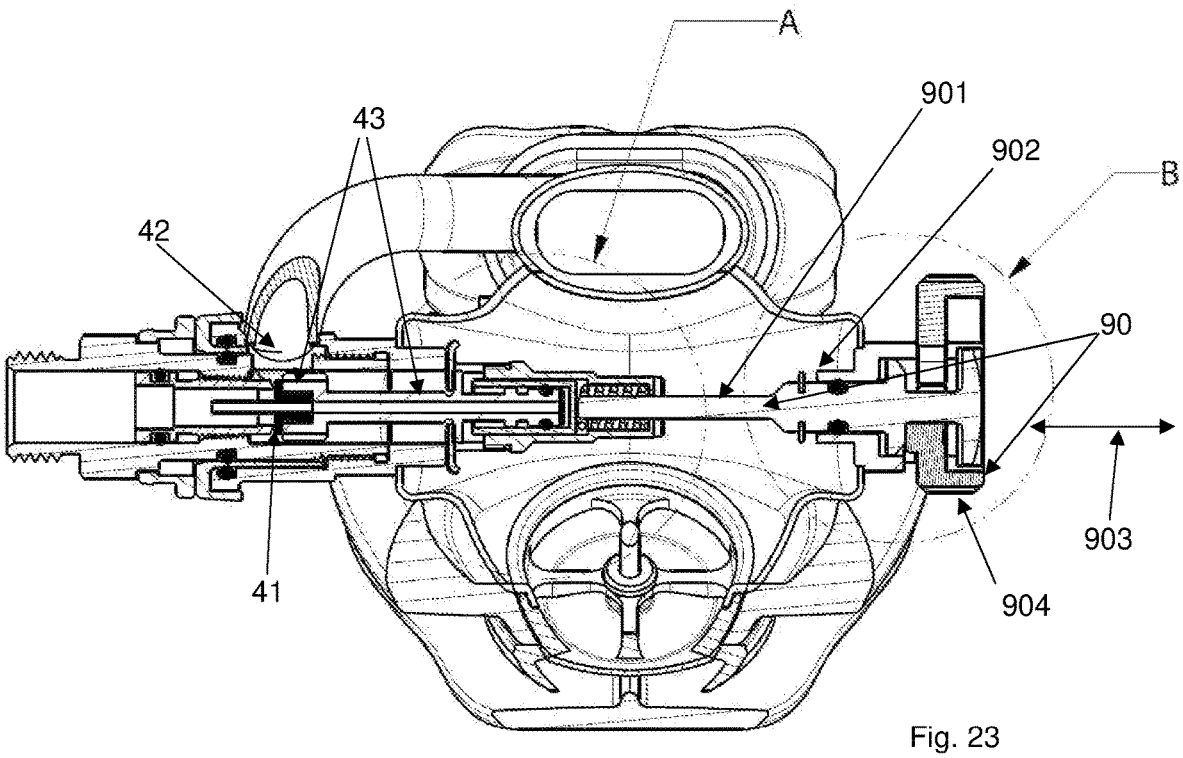
Figure 24:
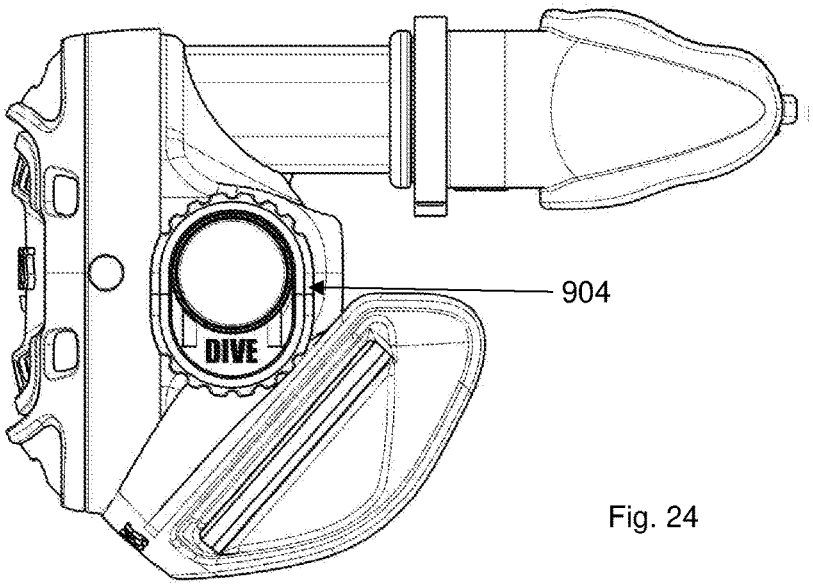
Figure 25:
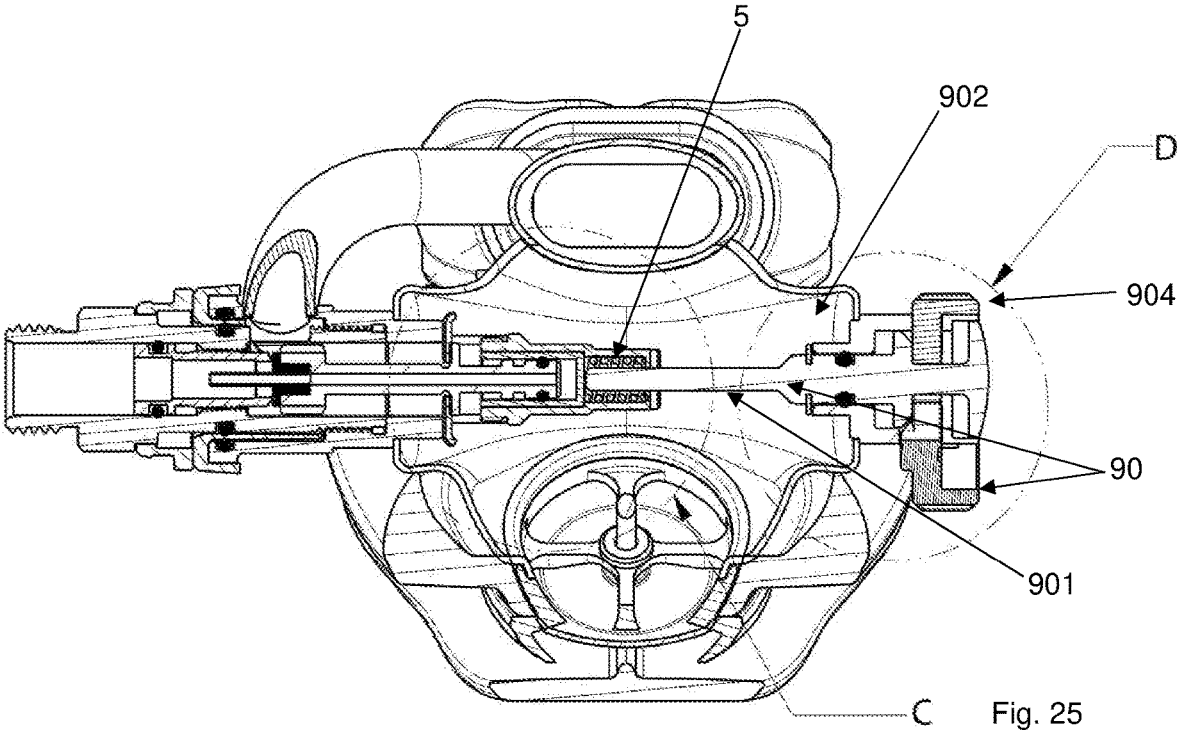
Figure 26:
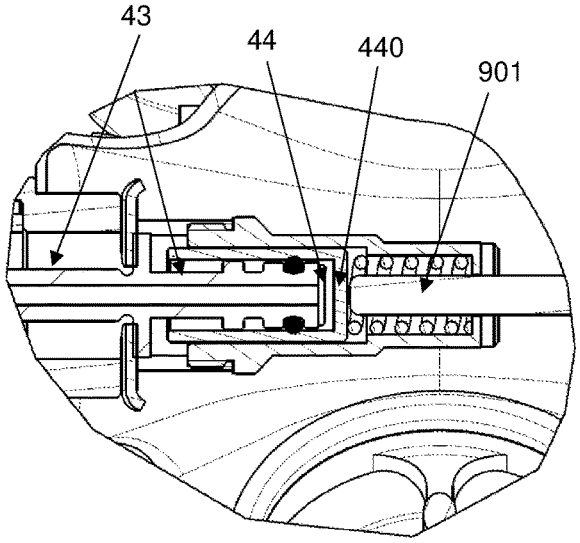
Figure 27:
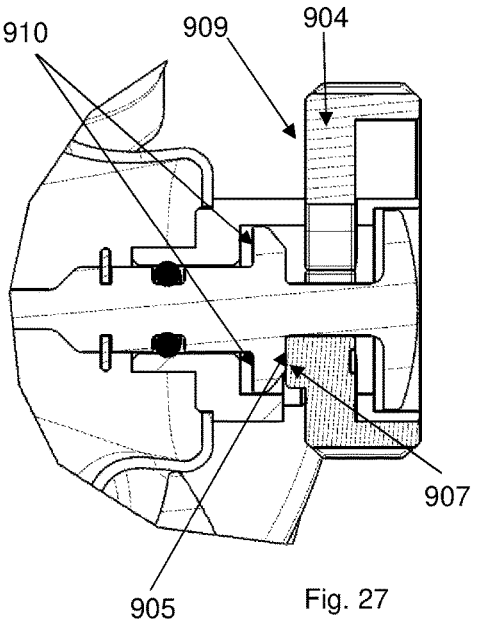
Figure 28:
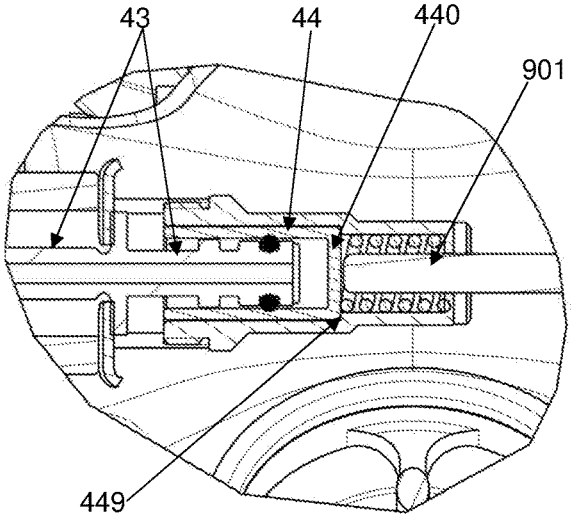
Figure 29:
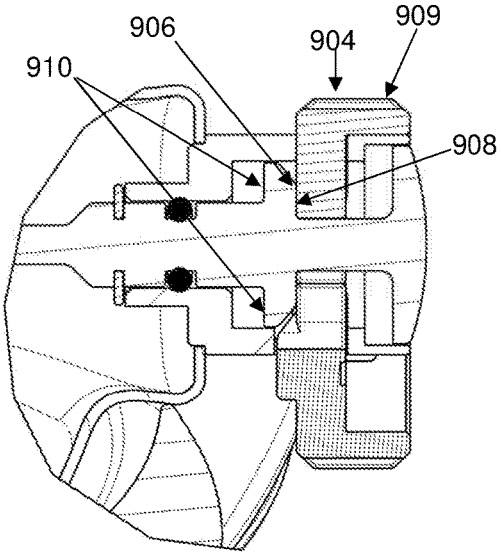

FIGS. 9 and 10 respectively show the enlargements A and B of FIG. 8;

FIGS. 11 to 14 show different operating steps of a reducing system according to the present invention;

FIG. 15 shows the movement of one component of the reducing system in succession and in a perspective view;

FIG. 16 shows the movement of the component in FIG. 15 in succession and in a side view;

FIGS. 17-19 show two opposite ends and a side view of a component in FIG. 15 or 16;

FIG. 20 shows a view according to the sectional plane A-A in FIG. 17;

FIG. 21 shows a schematic view of a breathing apparatus according to the present invention;

FIGS. 22 and 24 show side views of a reducing system in two distinct configurations;

FIGS. 23 and 25 show sectional views corresponding respectively to the configurations in FIGS. 22 and 24;

FIGS. 26, 27, 28, 29 respectively show enlargements of the details A, B, C, D in FIGS. 23 and 25.

In the accompanying figures, a pressure-reducing system for a breathing apparatus is denoted by the reference number 1.

As mentioned previously, the system 1 is advantageously used for diving applications, but could also be employed in other applications. With reference to the schematic view in FIG. 21, the present description preferably makes reference to a breathing system 10 comprising:

- a tank 9 of a breathable gas;
- a first pressure reduction stage 91 located downstream of the tank 9;
- a second pressure reduction stage 92 located downstream of the first stage 91;
- a tube 93 (for example a sleeve or also a flexible hose) that connects the first stage 91 to the second stage 92 and inside which the gas moves.

The pressure-reducing system 1 to which the present description relates is advantageously applied to the second stage 92.

Appropriately, in the course of the present description, intermediate pressure is understood as the pressure between the first and second stages 91, 92 (and, therefore, in the preferred application, the pressure immediately upstream of the system 1). For example, the intermediate pressure can be equal to about 10 bar (though it may vary for example with depth).

The reducing system 1 comprises a supply conduit 2 for supplying a pressurised breathable gas. The supply conduit 2 typically originates from the tube 93 coming from the first stage connected to the pressurised tank 9 of breathable fluid (the gas could also be in liquid form inside the tank 9). The breathable gas can be of various types: compressed air, nitrox, mixtures of oxygen, nitrogen and helium, or still others.

The system 1 also comprises a suction mouthpiece 3 for a user to breathe in the breathable gas. This enables the user to keep the second stage firmly in his or her mouth and thus to breathe.

The system 1 comprises a valve 4 interposed between the supply conduit 2 and the suction mouthpiece 3.

The valve 4 permits or prevents the passage of breathable gas from the supply conduit 2 to the suction mouthpiece 3.

The valve 4 in turn comprises:

- an inlet 41 for the breathable gas coming from the supply conduit 2;
- an outlet 42 for the breathable gas directed to the suction mouthpiece 3.

Figure 1:
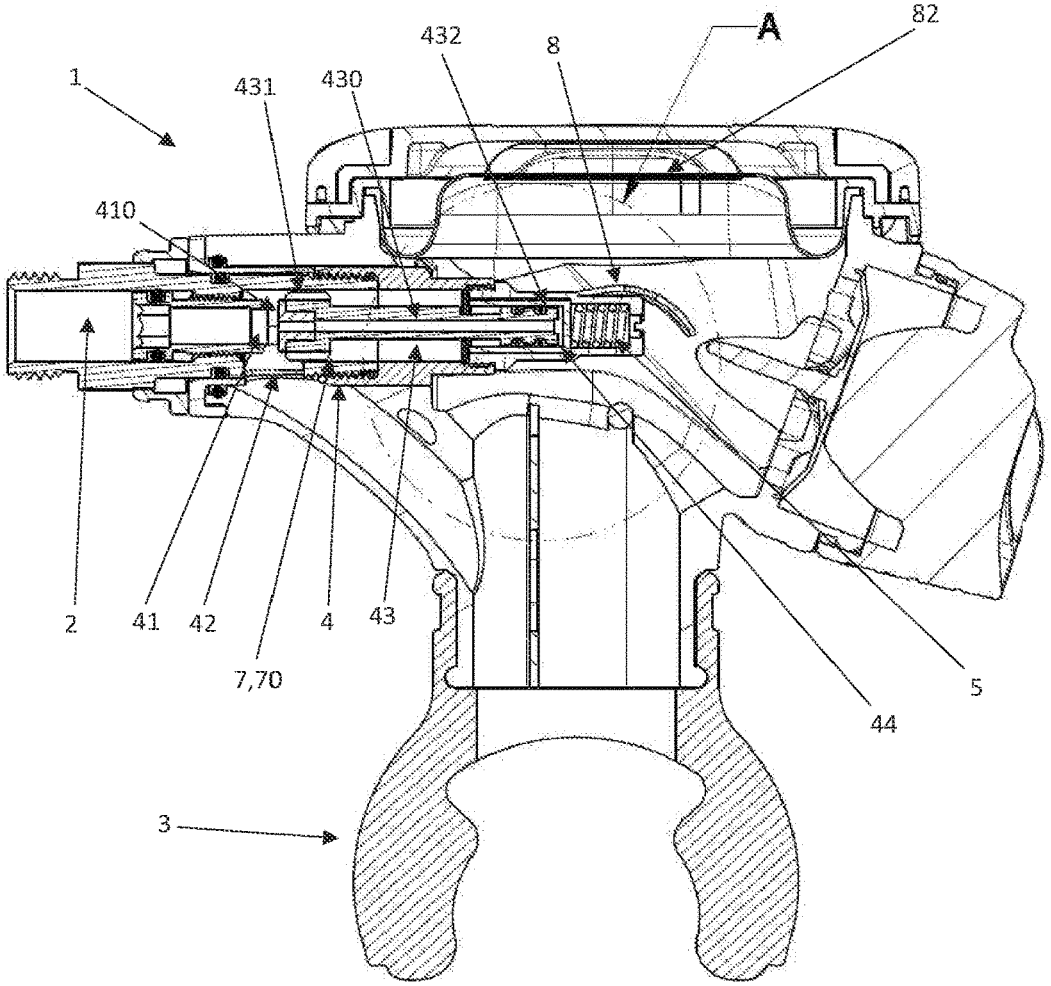
FIG. 1 shows a pressure-reducing system according to the present invention.
Figure 6:
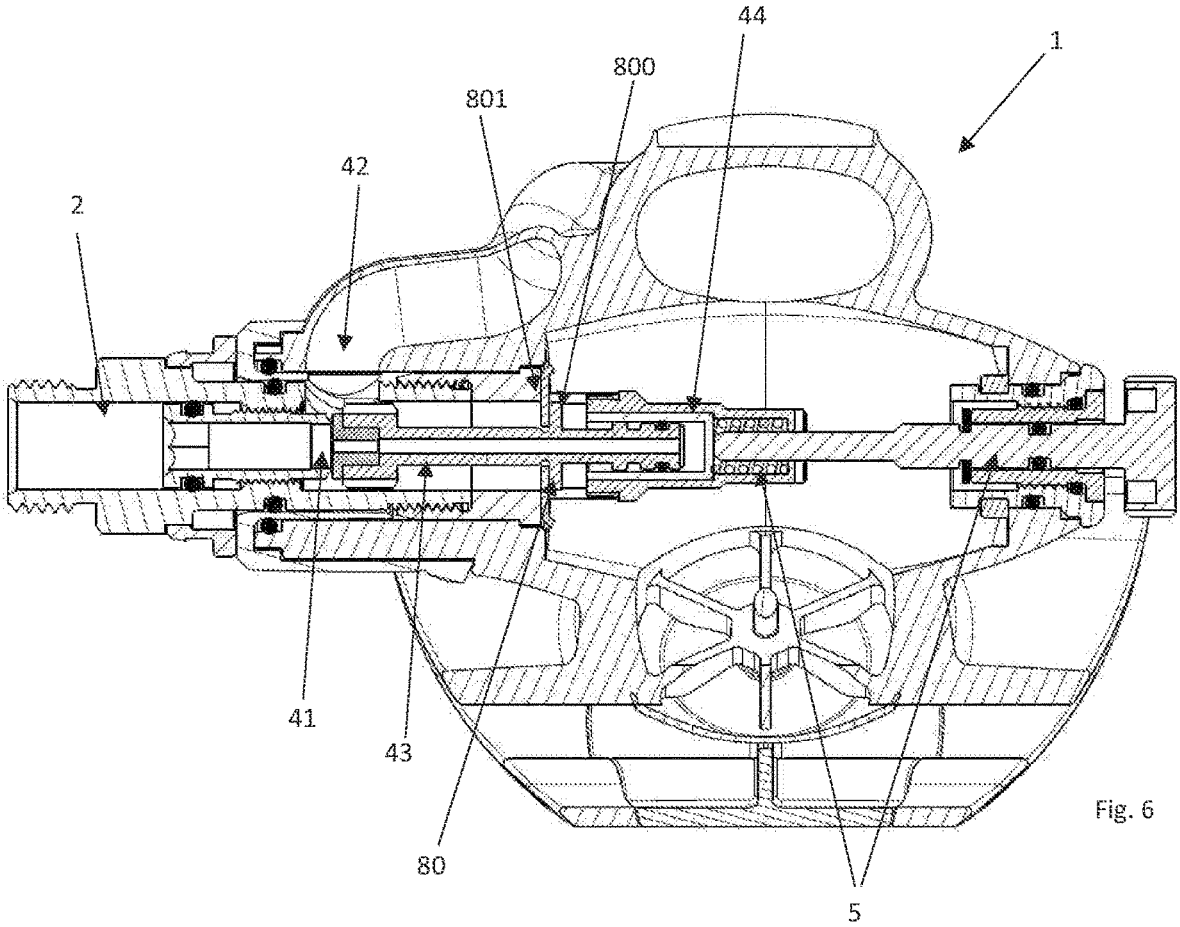

The outlet 42 is suitably defined by a by-pass conduit, shown by way of example in FIGS. 1 and 6 and not further described, being well known in the technical field.

The valve 4 also comprises a shutter 43 that is movable between a first position (see for example FIG. 13) and a second position (see for example FIG. 14) in which it respectively permits or prevents the passage of the breathable gas from the inlet 41 to the outlet 42. In the second position the shutter 43 is close to the inlet 41. The second position is also exemplified in FIGS. 3, 4, 5, 6, 7, 8, 23, 25. In the first position the shutter 43 is distanced from the inlet 41 (see FIG. 1; with reference to FIGS. 3, 4, 5, 6, 7, 8, 23, 25 this means that it is shifted towards the right compared to the image represented). In the first position the shutter 43 is thus distanced from the inlet 41. In a zone intended to come into contact with the inlet 41 the shutter 43 comprises a sealing element 410. The sealing element 410 is called "pad" in technical jargon. The inlet 41 against which the pad is pressed can leave an imprint on the latter (called "marking" in technical jargon). In fact, the inlet 41 can typically have a thin profile 411 to optimise the seal with the pad.

Conveniently, the valve 4 comprises a pressure balancing chamber 44. The expression "balancing chamber 44" is well known in the technical field, as during operation it enables at least a partial balancing of the force exerted by the pressure at the inlet 41. In the specific case, conveniently, no elastic spring is present between the shutter 43 and the balancing chamber 44. The shutter 43 is interposed between the inlet 41 of the valve 4 and the balancing chamber 44. The shutter 43 defines a passage 430 that places the inlet 41 of the valve 4 and the pressure balancing chamber 44 in fluid communication. The passage 430 extends inside the shutter 43. Purely by way of non-limiting example, the passage 430 can have an outflow cross section of a size comprised between 1 $mm^2$ and 2 $mm^2$.

When the shutter 43 is in the second position, during normal operation the balancing chamber 44 takes on the pressure value existing at the inlet 41 of the valve 4. This is thanks to the gas that flows from the inlet 41 to the chamber 44 by means of the passage 430. When the shutter 43 is in the first position, the gas also flows outside the shutter 43 to the outlet 42. In this case the gas flows in a space interposed between the shutter 43 and a seat 7 that laterally surrounds the shutter 43. The outlet 42 is advantageously obtained on a wall of the seat 7.

During the normal operation of the system, 1 the balancing chamber 44 is kept in a fixed position (towards the right for example in FIG. 1). This occurs by virtue of the intermediate pressure acting on the wall 440. The shutter 43 is shifted from the second to the first position as a consequence of the negative pressure caused on the mouthpiece 3 by the user, who draws gas in order to breathe it in (see FIG. 13). Once the negative pressure induced by the user's breathing in ends, the shutter 43 returns from the first to the second position due to the pressure exerted by the balancing chamber 44 (see FIG. 14). In fact, in this phase the pressure in the balancing chamber 44 is the same as the pressure at the inlet 41, but the force that causes the shutter 43 to close is greater than the one opposing it (as a consequence of the fact that the pushing surface that is usable in a closing direction of the shutter 43 is larger than the pushing surface that is usable in the opening direction; this is because inside the chamber 44 the shutter 43 has a pushing surface for closing that is larger than the surface of the shutter 43 which in the second position faces the section for the passage of gas into the inlet 41).

The system 1 also comprises a movement system 5 for moving the balancing chamber 44 towards the inlet 41 for the breathable gas to push the shutter 43 from the first to the second position, for example on the occurrence of preset operating conditions (typically depressurisation or blockage of the shutter 43 as a result of freezing). As better explained below, the movement system 5 intervenes spontaneously in the event of there being a depressurisation immediately upstream of the inlet 41 (depressurisation of the second stage typically occurs when the pressure immediately upstream of the inlet 41 is brought to "ambient pressure") or enables a manual intervention of the user in the event of occurrence of freezing which blocks the shifting of the shutter 43.

The balancing chamber 44 is therefore movable relative to the inlet 41 (although the movement in actual fact takes places place only under certain conditions). The movement means 5 induces the movement of the shutter 43 from the first to the second position as a consequence of the push received by the balancing chamber 44 in its stroke towards the inlet 41 (thus the movement system 5 pushes the balancing chamber 44, which in turn pushes the shutter 43). The balancing chamber 44 is conveniently shaped like a cup having an opening through which the shutter 43 is inserted.

Conveniently, the end of the shutter 43 that extends into the balancing chamber 44 comprises an annular gasket 99 (O-ring). During a stroke of the balancing chamber 44 as it is shifted towards the inlet 41, a back wall 440 of the balancing chamber is intended to push the shutter 43 against the inlet 41. Therefore, the system 1 can take on a configuration in which the back wall 440 of the balancing chamber 44 abuts against and pushes the shutter 43 towards the second (closed) position. The balancing chamber 44 slides along the seat 7 under the action of the movement system 5. In particular, the balancing chamber 44 slides along the seat 7 parallel to a preponderant direction of extension of the shutter 43.

The movement system 5 for moving the balancing chamber 44 can be of varying type. The system 5 is external to the balancing chamber 44. The balancing chamber 44 is interposed between the shutter 43 and the movement means 5. The movement system 5 typically comprises/coincides with a means for pushing the balancing chamber 44. Some example solutions are described below with reference to FIGS. 1-10.

Figure 2:
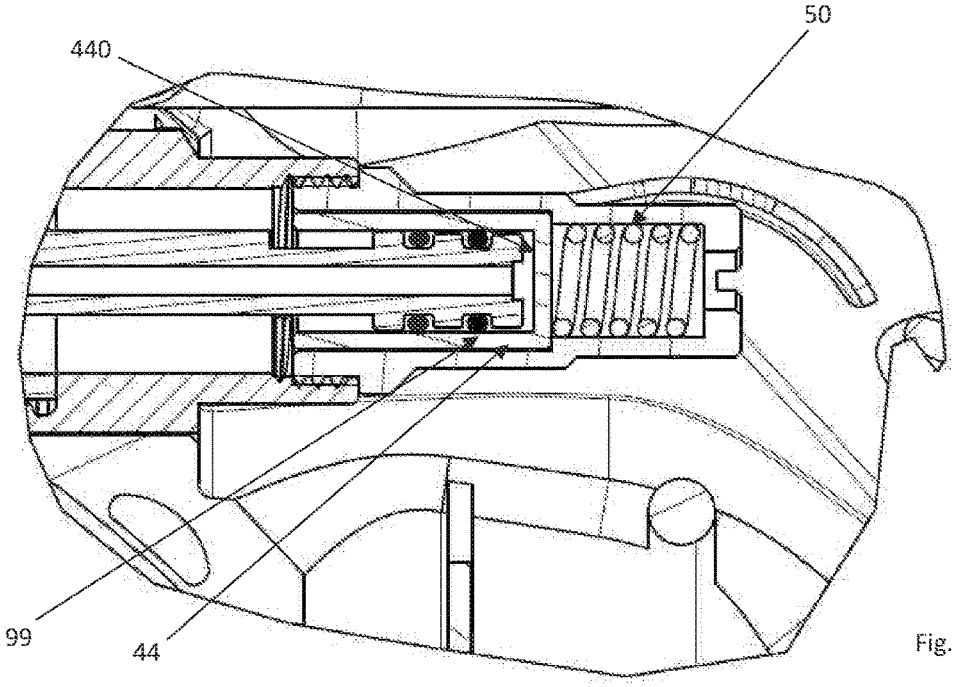
FIG. 2 shows an enlargement A of FIG. 1.

As illustrated by way of example in FIGS. 1 and 2, the movement system 5 comprises/coincides with an elastic means 50 that exerts a force which pushes the balancing chamber 44 towards the inlet 41 of the valve 4. This force manifests itself concretely in an actual movement when the system is depressurised. For example, the elastic means 50 comprises a spring, typically a helical spring. Optionally, there could be a plurality of helical springs arranged in series (optionally with an element of interposition between them). The elastic means 50 is external to the balancing chamber 44. The balancing chamber 44 is interposed between the elastic means 50 and the shutter 43. The elastic means 50 pushes on a rear wall (back wall 440) of the balancing chamber 44. The elastic means 50 is such as to offer a lesser force than is exerted by the intermediate pressure on the back wall 440 of the balancing chamber 44; consequently, it does not intervene in the operation of the system 1 if pressurised. However, when the line is purged (is depressurised upstream of the valve 4, see FIG. 11) the elastic means 50 enables the shutter 43 to be repositioned in (drawn into) the second position (closed position of the valve 4).

Furthermore, the elastic means 50 could be such that in the second position (closed position of the valve 4, i.e. when the elastic means 50 is in the configuration of minimum compression) it exerts a minimal force (so as to minimise the marking of the pad, a drawback described previously). This effect can be optimised, given that when the spring expands the force it exerts decreases, and thus the spring can be designed in such a way as to provide a sufficient force to initiate the movement of the balancing chamber 44, but such that after the travel stroke thereof (for example about 2 millimetres) the residual force is just sufficient to prevent the entry of water towards the first stage during rinsing.

Figure 11:
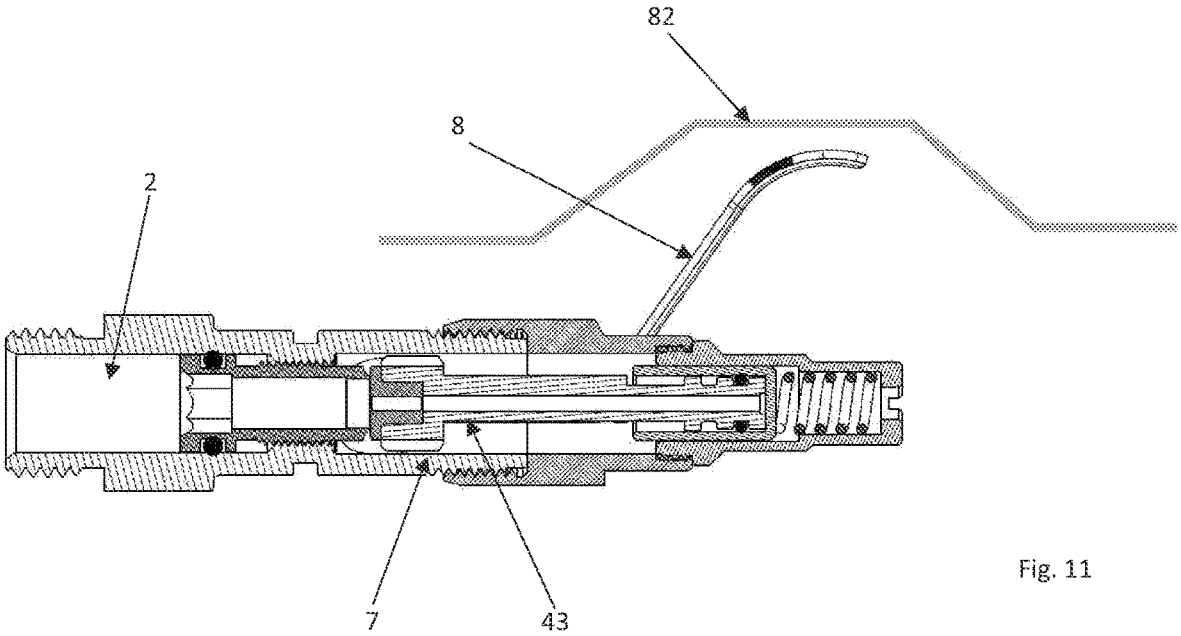
Figure 12:
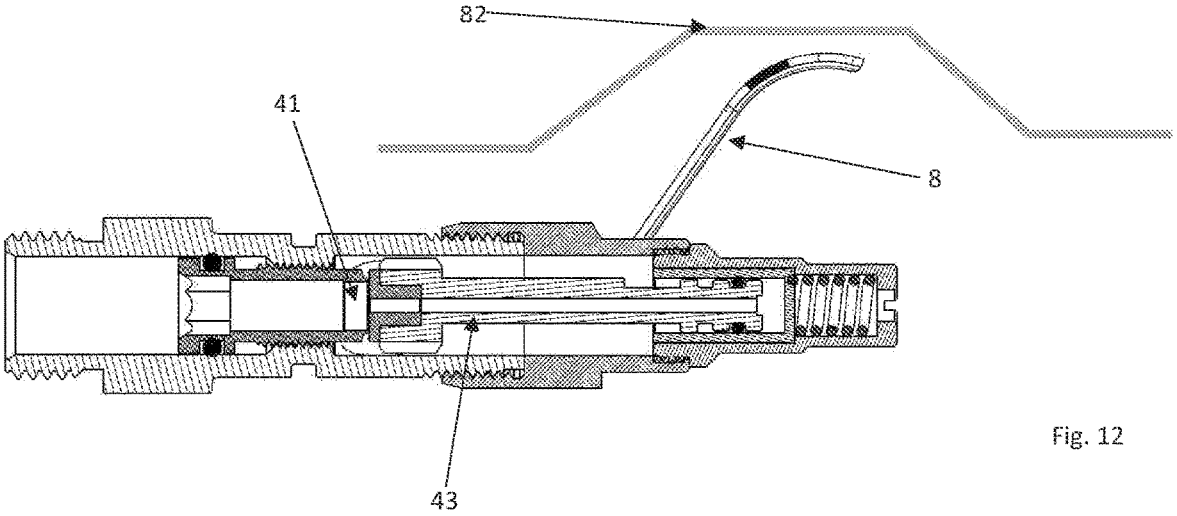
Figure 13:
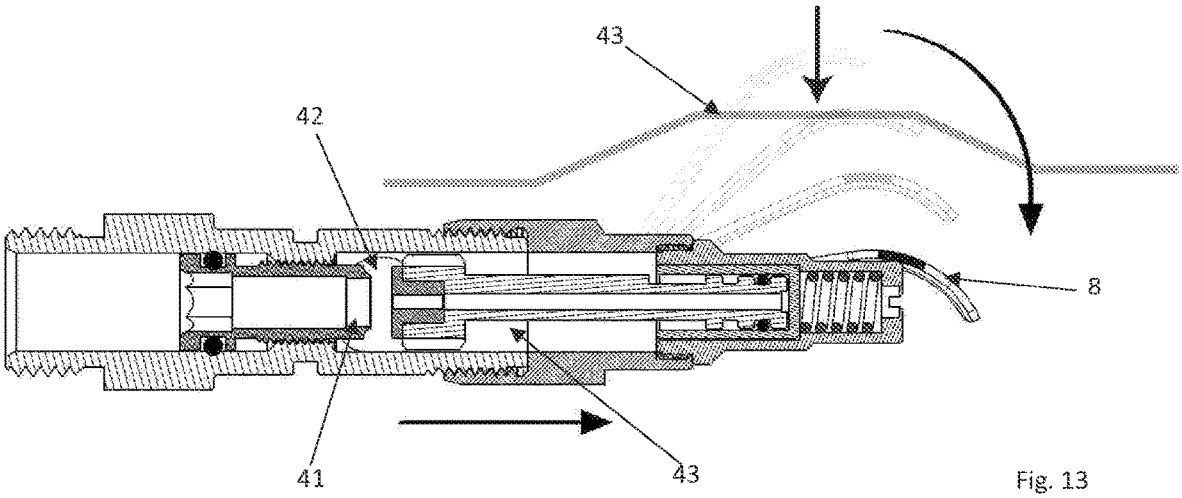
Figure 14:
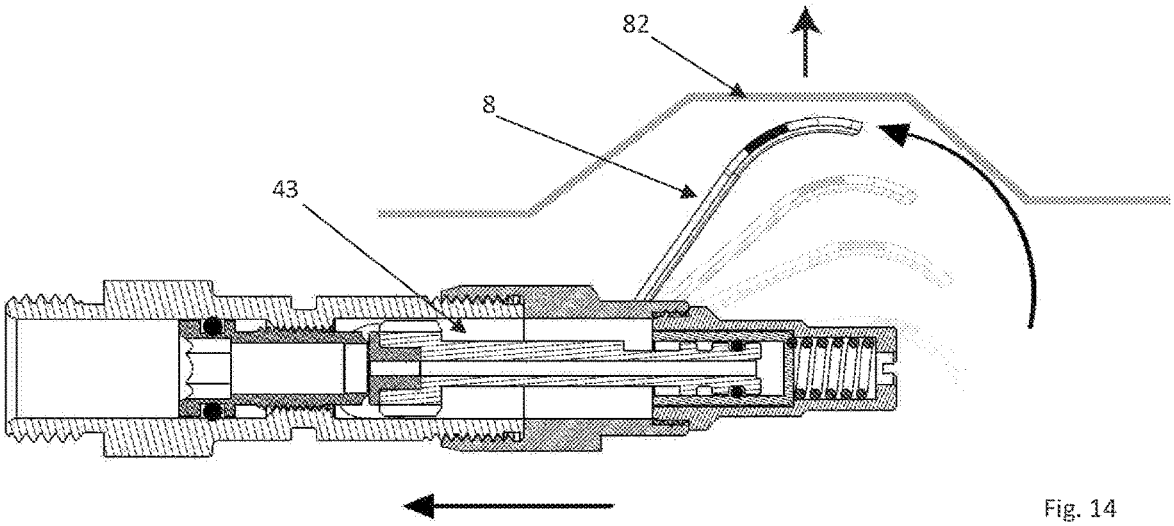

The configurations taken on by the system 1 are summarised in FIGS. 11-14:

- FIG. 11 (system 1 depressurised): the elastic means 50 pushes the balancing chamber 44 against the shutter 43, which takes on the second position;
- FIG. 12 (system 1 pressurised at rest): the pressure pushes the balancing chamber 44, which compresses the elastic means 50;
- FIG. 13 (system 1 at the start of breathing): the shutter 43 is moved into the first position as a result of breathing in, as better explained below;
- FIG. 14 (system 1 at the end of breathing): the shutter 43 is moved into the second position, as the negative pressure induced by breathing in is no longer present, as better explained below.

Reference will be made to the solution in FIGS. 22-29.

The system 1 can comprise a means 90 for regulating a maximum stroke of the shutter 43 (appropriately between the first and second positions). In particular, the regulating means 90 comprises a pusher 901 intended to abut against (directly or through the interposition of other means) a wall of the balancing chamber 44 (in particular the back wall 440). In this manner, the pusher 901 can regulate/limit the position of maximum distancing of the balancing chamber 44 from the inlet 41. The pusher 901 is shaped like a rod. The pusher 901 acts on the balancing chamber 44 so as to regulate the maximum stroke of the shutter 43 accordingly. Conveniently, the elastic means 50 surrounds at least a portion of the pusher 901.

The pusher 901 extends from the balancing chamber 44 in an opposite direction relative to the shutter 43.

Advantageously, the pusher 901 and the shutter 43 are intended to move along a same direction 903.

The system 1 comprises a casing 902 in which the valve 4 and/or the balancing chamber 44 are placed. The pusher 901 is intended to abut against the balancing chamber 44 and limit the stroke of the shutter 43 accordingly; in particular, the pusher 901 can regulate/limit the position of maximum distancing of the balancing chamber 44 from the inlet 41 of the valve 4 (in this regard, the pusher 901 can advantageously be stably regulated in a plurality of positions). The pusher 901 comes into contact with the balancing chamber 44 inside the casing 902. The means 90 for regulating the maximum stroke of the shutter 43 also comprises a system 904 for controlling the pusher 901. The control system 904 allows the pusher to be stably positioned in a plurality of positions so as to regulate the position of maximum distancing of the balancing chamber 44 from the inlet 41 of the valve 4. The control system 904 is movable between a first configuration and a second configuration. The shifting between the first and second configurations takes place manually. A reduced stroke of the shutter 43 between the first and second positions is associated with the first configuration (see FIGS. 22, 23, 26, 27). An extended stroke of the shutter 43 between the first and second positions is associated with the second configuration (see FIGS. 24, 25, 28, 29). For example, in the second configuration the action of the pusher 901 could be superfluous, since the position of maximum distancing of the balancing chamber 44 from the inlet 41 of the valve 4 could be imposed by an additional retaining element 449 (for example an annular wall as illustrated by way of example in FIG. 28). Therefore, in the second configuration the pusher 901 does not necessarily abut against the back wall 440. The balancing chamber 44, in particular the back wall 440, is intended to push the pusher 901 away from the shutter 43 or in any case away from the inlet 41 of the valve 4.

The control system 904 comprises a first abutment 905, which, in the first configuration, opposes the distancing of the pusher 901 from the inlet 41 of the valve 4 (in other words towards the outside of the casing 902). In the first configuration the first abutment 905 is in contact with a first stop element 907 of the pusher 901.

The control system 904 comprises a second abutment 906, which, in the second configuration opposes the distancing of the pusher 901 from the inlet 41 of the valve 4 (in other words, towards the outside of the casing 902). In the second configuration the second abutment 906 is in contact with a second stop element 908 of the pusher 901. Conveniently, in the second configuration the first abutment 905 is not in contact with the first stop element 907 of the pusher 901. The first and second stop elements 907, 908 are advantageously obtained on a same annular protrusion 910 of the pusher 901. The second abutment 906 is more external than the first abutment 905. Conveniently, the distance of the first abutment 905 from the inlet 401 of the valve 4 is smaller than the distance of the second abutment 906 from the inlet 401 (or at least this condition is met if one evaluates only the component of the distance along the direction 903).

The control system 904 comprises a selector 909 integrating the first and second abutments 905, 906. In particular, they could be integrated into a single unassembled body. As exemplified in FIGS. 22-24, the selector 909 is movable. A shifting of the selector 909 makes it possible to move the pusher 901 and pass from the second to the first configuration. Conveniently, the selector 909 interacts with the annular protrusion 910 to bring about the movement of the pusher 901 and the passage from the second to the first configuration. In an alternative solution, not illustrated, the selector 909 can be rotated so as to pass from the first to the second configuration and vice versa. For example, there could be a lever with a cam profile. In the first configuration the pusher 901 is forced towards the inside of the casing 902 for a length comprised between 1.5 and 1.9 millimetres compared to the second configuration. For example, the stroke of the shutter 43 can be comprised between 2 and 2.5 millimetres. The purpose of this regulation is to limit the outflow of breathable gas in situations where the second stage is necessarily made to supply air automatically; for example an instructor on the surface with a student in difficulty, who thus makes abrupt movements without the second stage in his or her mouth; in fact, in such a situation the second stage could be activated due to repeated striking of the same on the surface of the water). Advantageously, also in the configuration with a reduced stroke there would be a sufficient flow of gas to assure breathing at least down to 10 metres of depth.

In FIGS. 22-29, the means 90 for regulating a maximum stroke of the shutter 43 is exemplified as an optimisation of the solution in FIGS. 1 and 2, but, for example, it can also be applied to the other solutions illustrated or described.

Figure 3:
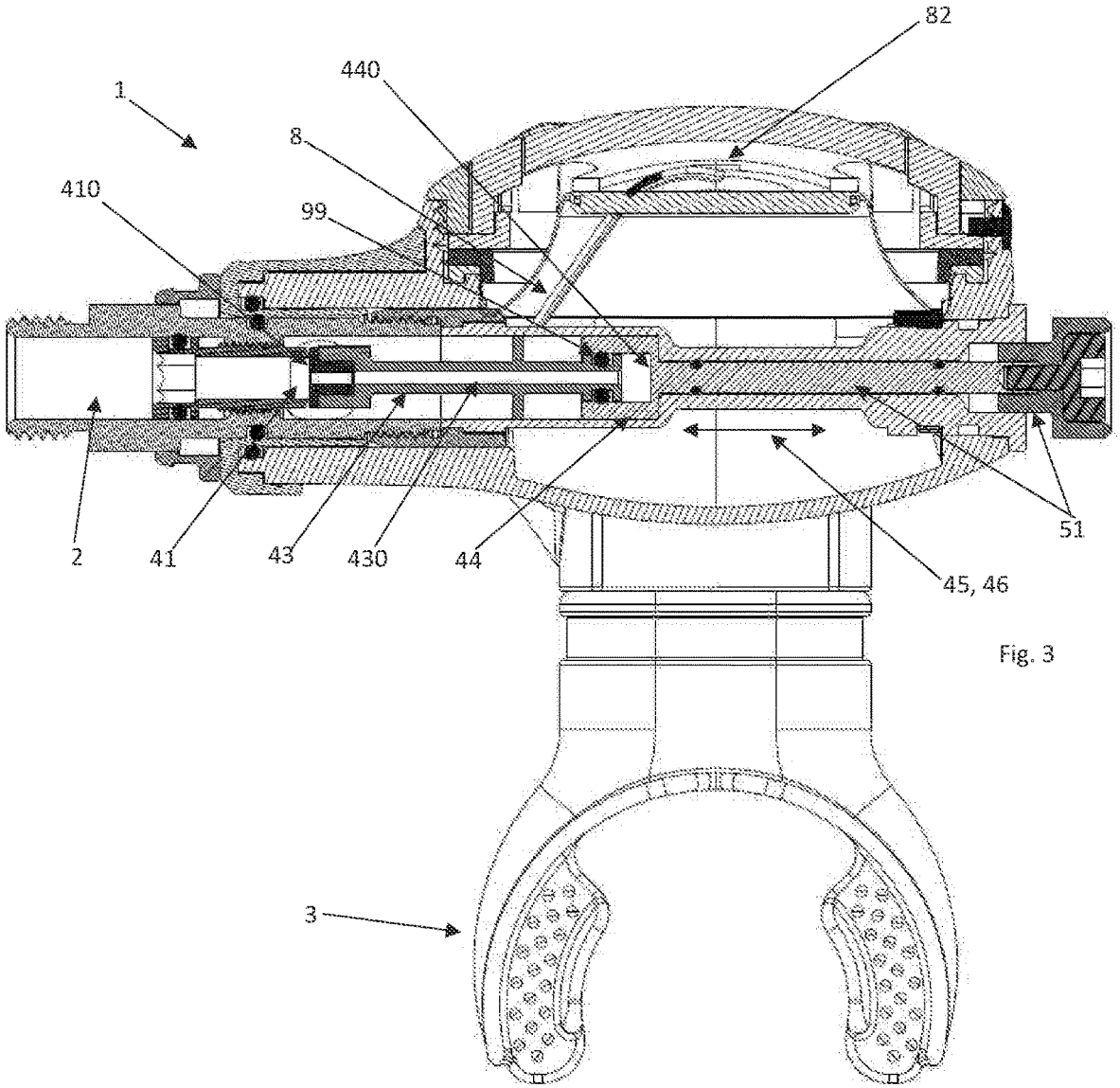
FIG. 3 shows a further solution of a pressure-reducing system according to the present invention.

In the solution exemplified in FIG. 3, the movement system 5 for moving the balancing chamber 44 conveniently comprises a manual push actuator 51 for pushing the balancing chamber 44 towards the inlet 41 of the valve 4. The actuator 51 projects outside the second stage, making it accessible by a user. The actuator 51 is for example a pusher. Therefore, by manually pushing the actuator 51, the user moves the balancing chamber 44, which in turn pushes the shutter 43 from the first to the second position. For example, the user can act manually on the actuator 51 before rinsing the system 1, before pressurising the system (to ensure that the shutter 43 is in the closed position) or under emergency conditions should the shutter be blocked due to freezing (as explained in greater detail below). In this manner the valve 4 is closed by repositioning the shutter 43 in the second position. Advantageously, the actuator 51 is in a single body or assembled with the balancing chamber 44. Optionally, the actuator 51 and the chamber 44 could be connected by means of an intermediate mechanism (solution not illustrated).

Figure 4:
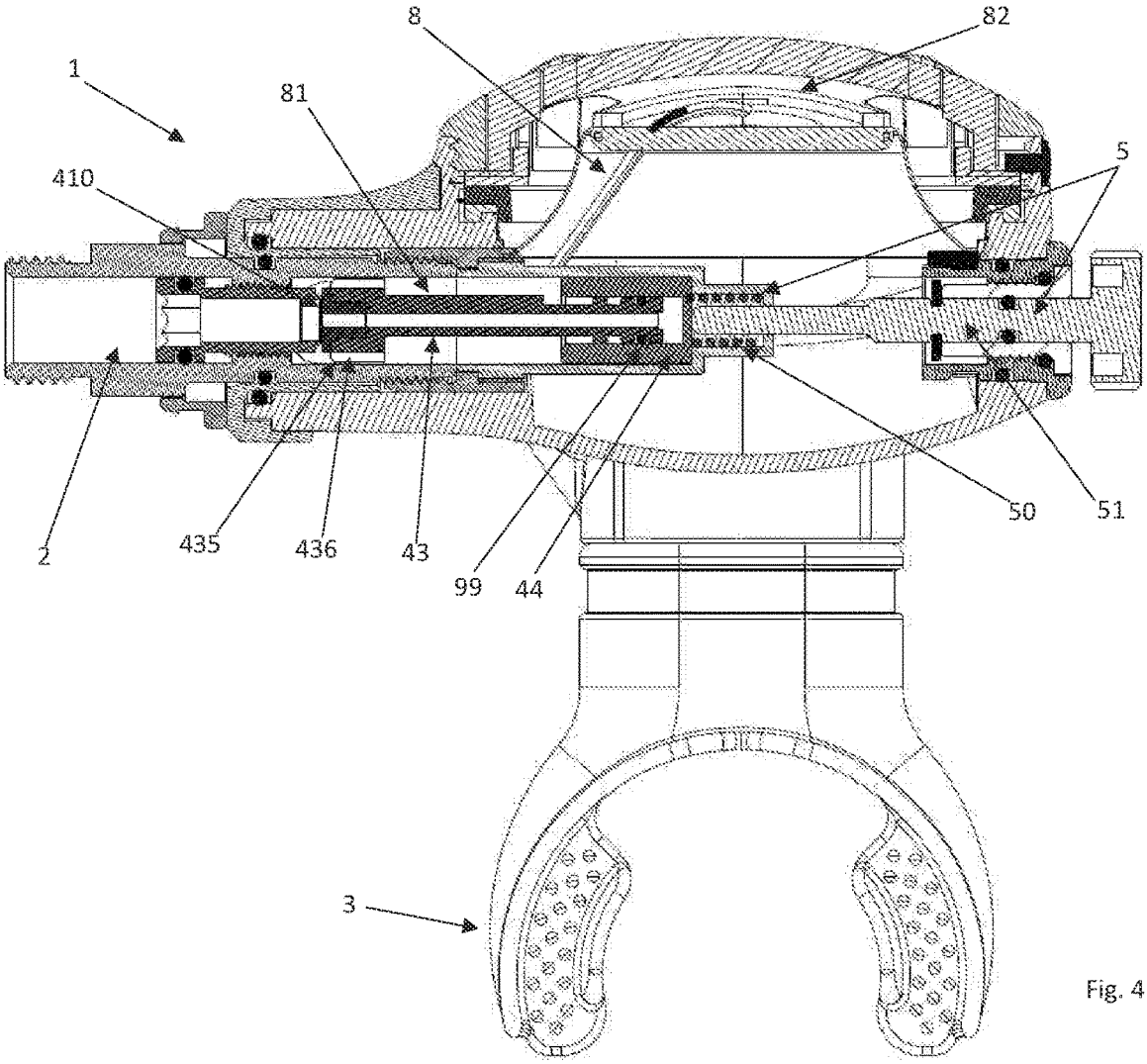
FIGS. 4 and 6 show a further solution of a pressure-reducing system according to the present invention.
Figure 5:
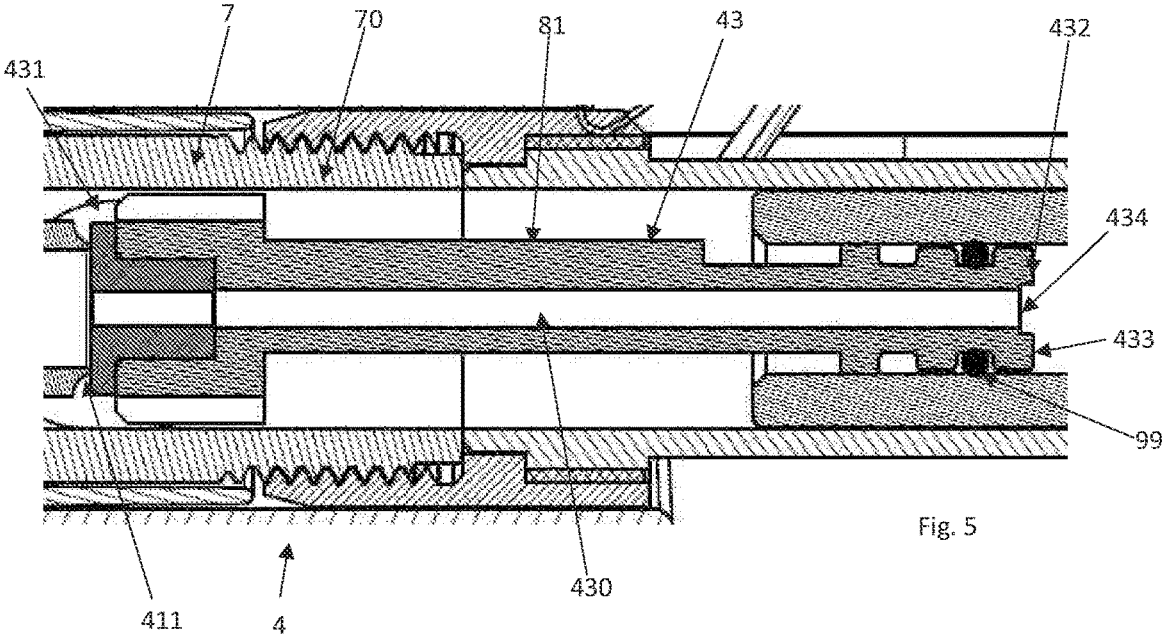
FIG. 5 shows an enlargement of FIG. 4.

In the solution exemplified in FIGS. 4-6, the actuator 51 passes through the elastic means 50. This solution can thus be understood as a combination of the solution in FIG. 1 and the one in FIG. 3.

The balancing chamber 44 is movable towards the inlet 41 of the valve 4 both by means of the actuator 51 and by means of the elastic means 50. Conveniently, what was previously described with reference to the solution in FIG. 1 and/or FIG. 3 can be repeated here. In particular the actuator 51 passes through a helical spring that is part of the elastic means 50. Such a solution is particularly interesting, as it allows the advantages of the solution in FIGS. 1 and 2 to be combined with the fact that the manual actuator 51 enables the shutter 43 to be released in the event that it becomes blocked in the first position (valve 4 open). This could for example occur, since the breathable gas exiting the first stage is typically at −40° C.; it is warmed between the first and second stages, but, especially if the user is in cold water, it could nonetheless enter the second stage at temperatures below 0° C. Should this flow come into contact with water (for example due to infiltration from the exhaust valve of the second stage or an imperfect seal of the diaphragm), the latter could freeze and block the shutter 43. Consequently, the manual push by means of the actuator 51 would enable its release. Once the shutter 43 was in the second position (valve 4 closed) the passage of gas in the balancing chamber 44 would enable the user to release the actuator 51 without compromising correct operation.

In such a solution the movement system 5 thus comprises a manual actuator 51 and a mechanical spring 50 (the latter being absent, by contrast, in the solution of FIG. 3).

Figure 7:
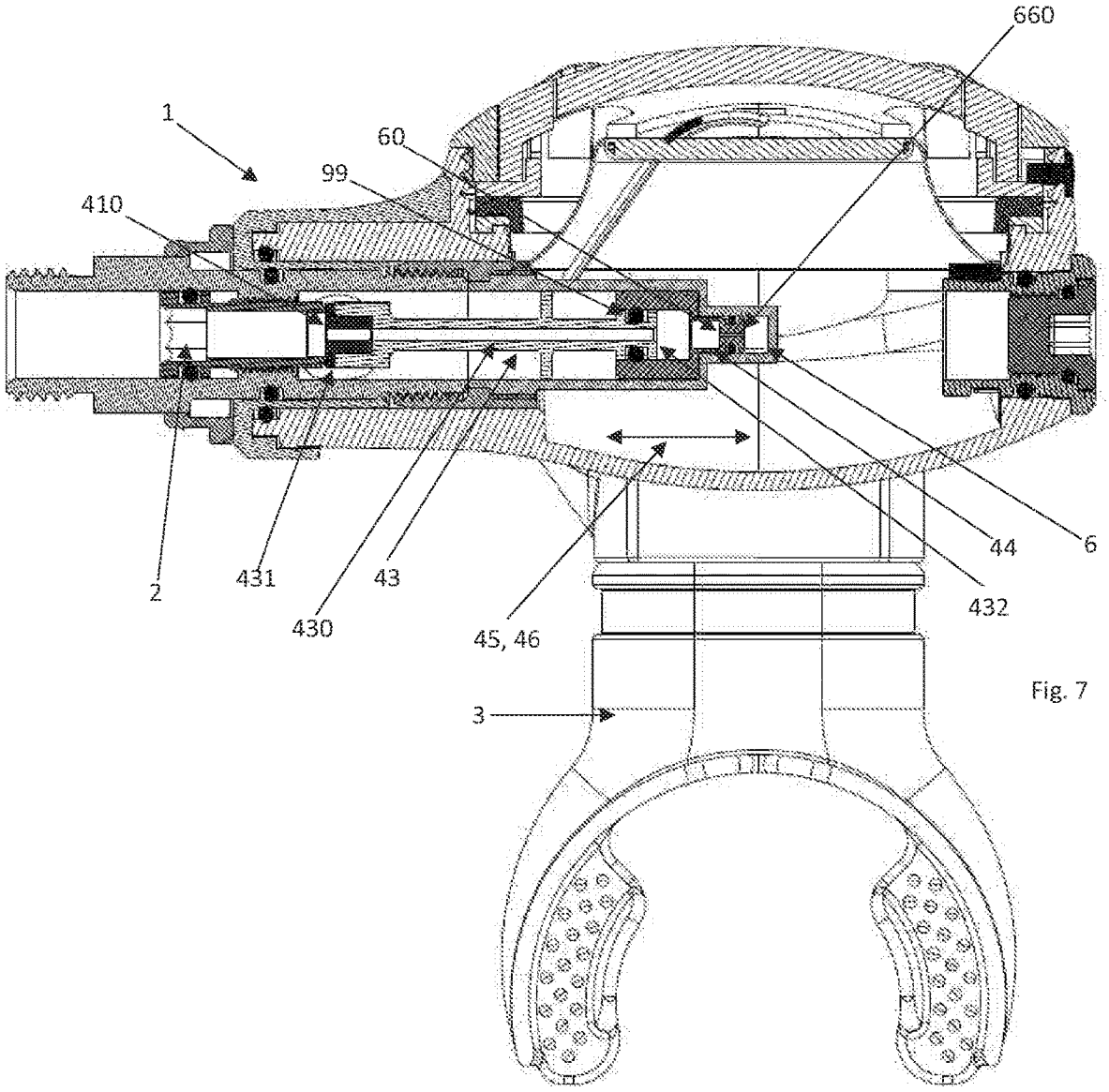
FIGS. 7 and 8 show two further solutions of a pressure-reducing system according to the present invention.

In the solution exemplified in FIG. 7, the movement system 5 for moving the balancing chamber 44 comprises an auxiliary chamber 6 placed in fluid communication with said balancing chamber 44. Conveniently, this takes place by means of a channel 60 having an outflow cross section of reduced size. For example, the cross section could be less than 1 $mm^2$ or less than half of the outflow cross section of the passage 430. The outflow cross sections are determined orthogonally to the direction of the fluid outflow. If they are not constant along the longitudinal extent, the minimum cross section can be taken into consideration. The balancing chamber 44 is thus interposed between the auxiliary chamber 6 and the shutter 43. When the system 1 is pressurised, in addition to the chamber 44 being pressurised, the chamber 6 is pressurised more slowly. As the surface 660 of the chamber 44 is exposed to the chamber 6 having a surface that is smaller than the back wall 440, the net effect of the pressurisation is that the balancing chamber 44 is distanced from the inlet 41 (i.e. it is shifted towards the right in the image in FIG. 7). The chamber 6 thus becomes a chamber with an intermediate pressure (the pressure between the first and second stages). When the user purges the pressure-reducing system 1, the balancing chamber 44 will release the pressure through the passage 430 much more quickly compared to the auxiliary chamber 6 (the difference in speed is induced by the fact that the channel 60 has a reduced outflow cross section). A force is thus generated which pushes the chamber 44 towards the inlet 41 (i.e. towards the left with reference to FIG. 7) and by doing so also pushes the shutter 43 towards the inlet 41 (i.e. into the second position, in which the valve 4 is closed). Therefore, the user can rinse out the system 1 without water leaking into the conduit 2 (with the risk of it reaching the first stage). With the passing of time, the overpressure in the auxiliary chamber 6 will also be exhausted; it is thus advisable for the user to carry out a rinse without waiting too long. This solution, too, is of interest, since it enables the problems of the prior art to be solved, but it is not the preferred solution; in fact, should a diver descend to great depths, because of the increase in the intermediate pressure with the ambient pressure, he or she would then have to pay extra attention to the speed of reascent compared to the previous solutions to allow the pressure in the chamber 6 to be balanced with the pressure in the chamber 44 in order to prevent a large difference in pressure from causing the chamber 44 to be shifted towards the inlet 41 despite the system being pressurised.

In the solution exemplified in FIG. 8, the movement system 5 is similar to the one in FIG. 7, but instead of being based on reduced cross sections to differentiate the speed of depressurisation of the chambers 44 and 6, it exploits a one-way valve 61 and a vent valve 62. In particular, the movement system 5 comprises:

an auxiliary chamber 6;

a one-way valve 61 that permits outflow from the pressure balancing chamber 44 to the auxiliary chamber 6. This allows a push to be obtained which, when the system is depressurised, can bring the system back into the closed position. In this manner, the auxiliary chamber 6 can be pressurised; in this case it will be pressurised at the time of final testing of the regulator in the factory and remain so until a future overhaul/maintenance. The balancing chamber 44 is interposed between the auxiliary chamber 6 and the shutter 43. The presence of the one-way valve 61 implies that the auxiliary chamber 6 will not be depressurised when the system 1 is depressurised and will thus be able to exert a force to close the valve 4 when the rest of the system 1 is depressurised. Therefore, the auxiliary chamber 6 performs the function of the elastic means 50 of the solution in FIGS. 1, 2, 4-6. The auxiliary chamber 6 can in fact be considered a pneumatic spring. Hence, in the solution exemplified in FIG. 7 or in FIG. 8, the movement system 5 is pneumatic (whereas in the solutions exemplified in the preceding figures it is elastic or manual).

Conveniently, the auxiliary chamber 6 can comprise a vent valve 62 for venting pressure when a pressure threshold is exceeded. It thus operates as an overpressure relief valve. With an appropriate setting of the overpressure tolerated prior to venting, this makes it possible to avoid the drawbacks described earlier in the case of a reascent from depths that could impact the regular operation of the system 1. In fact, the pressure upstream of the pressure-reducing system 1 (i.e. the pressure between the first and second stages) increases with increasing depth. Therefore, at great depths there could be higher pressures in the auxiliary chamber 6 than foreseen at lesser depths. During a reascent, the higher pressure in the chamber 6 relative to the intermediate pressure could cause the balancing chamber 44 to be shifted towards the inlet 41, thus bringing the shutter 43 all the way against the chamber 44 itself and impairing the performance of the regulator. For example, the vent valve 62 can be set at a pressure that is greater than the sum of the ambient pressure and intermediate pressure; for example, the vent valve 62 can be activated when the sum of the ambient pressure and intermediate pressure is exceeded by a preset amount; this preset amount could for example be a value comprised between 0.5 and 1 bar.

Particular constructive features are described below. One or more of such features are compatible with any of the example constructive solutions described previously.

A first of such features regards the shutter 43, which extends between a first and a second end 431, 432. The first end 431 is nearer the inlet 41 of the valve 4 than the second end 432.

The second end 432 comprises a flat surface 433 which is orthogonal to a direction 45 of shifting of the shutter 43 between the first and second positions. A groove 434 is obtained on the flat surface 433 and intersects the passage 430. Conveniently, the passage 430 and the groove 434 extend along two reciprocally transverse, or rather orthogonal, directions. The groove 434 enables the exit of the gas from the passage 430 to be facilitated when the flat surface 433 comes to abut against a facing surface obtained in the balancing chamber 44.

A further feature is illustrated below. As previously mentioned, the pressure-reducing system 1 comprises a seat 7 for housing the shutter 43. In particular, the pressure-reducing system 1 comprises a seat 7 housing at least a first section 435 of the shutter 43 comprising the first end 431. As exemplified in the combination of FIGS. 4 and 5, the first section 435 of the shutter 43 comprises a head that is sufficiently wide and long to accommodate the pad 410. As exemplified in FIGS. 15-18, as well as in FIGS. 4 and 5, the first section 435 also comprises a plurality of centring fins 436 that extend towards a wall 70 delimiting the seat 7. This allows the shutter 43 to be correctly aligned with the inlet 41 of the valve 4, since in the absence of planarity between the pad 410 and the sealing profile 411 of the valve seat there would be leakage of breathable gas also in the closed position of the shutter 43. The fins 436 enable, in fact, the correct positioning of a longitudinal axis of the shutter 43 with a longitudinal axis of the seat 7.

At the same time, the presence of fins 436 rather than a full surface perfectly matching in shape with the transverse profile of the seat 7 makes it possible to facilitate the passage of gas between one fin and the other. This prevents a "sail" effect, with the gas striking against the shutter 43 and causing the rearward movement thereof before the flow of gas inside the passage 430 has time to stabilise a pressure value in the balancing chamber 44, as a result of which the valve 4 will remain open. Conveniently, the fins 436 have a portion turned towards the inlet 41 of the valve 4 which is rounded or bevelled. This allows for reducing resistance to the movement of the shutter 43 (sharp edge that "scrapes") as well as to the passage of gas. In fact, the greater such resistance is, the more difficult the passage of the shutter 43 from the first to the second position will be (i.e. the more difficult it will be to close the shutter 43). The rounding is also present on the other extremity of the fins 436, in this case for the sole purpose of preventing a sharp edge from scraping against the inner wall of the seat 7.

As exemplified in the accompanying figures, the pressure-reducing system 1 comprises a lever 8 for shifting the shutter 43 between the first and second positions. Conveniently, the reducing system 1 comprises a diaphragm 82 which is deformable by the user's breathing in. In fact, by breathing in, the user brings about a negative pressure that deforms the deformable diaphragm 82, causing it in turn to shift the lever 8 (see FIG. 13). This in turn induces a shifting of the shutter 43 from the second position to the first position, thereby permitting the passage of the breathable gas. Once the effect of breathing in is over, the lever 8 goes back into the original position (see FIG. 14). As exemplified in FIG. 6 or 15 and 16, the shutter 43 comprises a means 80 of interacting with the lever 8. The interacting means 80 can comprise a wall 800 against which one or more feet 801 of the lever 8 can rest. When the lever 8 is rotated, the feet 801 rotate and, being opposed on one side, they push the shutter 43 from the second to the first position (they open the shutter 43).

As may be seen in FIG. 5, or in FIGS. 15 to 20, the shutter 43 also comprises a flat zone 81 that extends longitudinally parallel to a preponderant direction of extension 46 of the shutter 43. The flat zone 81 connects the fins 436 and the interacting means 80. The flat zone 81 has the purpose of minimising the risk of oscillations of the shutter 43 during opening. In fact, when the shutter 43 passes from the second to the first (open) position, the gas coming from the inlet 41 is introduced not only into the passage 430, but also flows outside the shutter 43. Every protuberance/wall of the shutter perpendicular to the direction of flow outside the shutter itself acts like a "sail" which, when struck by the flow of gas, causes the shutter 43 to move rearward and disrupts the correct movement thereof. This can bring about undesirable uncertainties in the shifting of the shutter 43.

The subject matter of the present invention further relates to a method for operating the system 1 (having one or more of the features specified previously). In particular, the method comprises a step of pushing the balancing chamber 44 towards the inlet 41 of the breathable gas when the system is depressurised (i.e. when there is a pressure drop immediately upstream of the inlet 41, typically when the pressure in that zone becomes equal to the outside ambient pressure, in particular it becomes equal to atmospheric pressure). This takes place by means of the movement system 5. This brings about the passage of the shutter 43 from the first position, in which it permits the outflow of the gas through the valve 4, to the second position in which the flow is interrupted.

To recap what was already described previously in the case of depressurisation:

- in the solution in FIGS. 1-2 and 4-6, the step of pushing the balancing chamber 44 towards the inlet 41 takes place spontaneously under the action of the elastic means 50. When the pressure upstream of the inlet 41 decreases, there is a decrease in the pressure in the balancing chamber 44 and the elastic means 50 is thus able to shift the balancing chamber 44.
- in the solution in FIG. 3, the step of pushing the balancing chamber 44 towards the inlet 41 is induced by a manual movement of the actuator 51 performed directly by the user (this operation could also take place in the absence of a depressurisation, for example to overcome a blocking of the shutter 43 induced by freezing). This could also occur in the solution in FIGS. 4-6;
- in the solution in FIG. 7, the step of pushing the balancing chamber 44 towards the inlet 41 takes place spontaneously under the action of the auxiliary chamber 6 connected with the balancing chamber 44 by means of the channel 60 having a smaller outflow cross section than the passage 430;
- in the solution in FIG. 8 the step of pushing the balancing chamber 44 towards the inlet 41 takes place spontaneously under the action of the auxiliary chamber 6 (pressurised beforehand with the passage of pressurised gas from the chamber 44 by means of the one-way valve 61).

The invention thus conceived enables multiple advantages to be achieved:

- easy assembly: the absence of a spring inside the balancing chamber 44 permits an assembly without calibration; thus, there is a reduction in costs and a use of components that are all identical;
- better preservation of the pad, which in the first position of the shutter 43 (i.e. closed position) presses against the valve inlet 41; in fact, with the present invention, when the regulator is not in use there is less stress on the pad (less marking, as referred to in technical jargon);
- an increase in the pressure upstream of the valve 4 (i.e. the intermediate pressure between the first and second stages) does not cause leakage or bothersome hissing, but rather enables a better closure of the shutter 43; small increases in pressure will thus go unobserved, whilst significant increases will in any case be controlled by an overpressure relief valve (which could be the valve 62 in FIG. 8 or a further valve mounted directly on the first stage);
- better breathing comfort: in a solution with an opposing spring that acts directly on the shutter (in technical jargon, a downstream valve with a spring), when the valve opens there is a larger compression of the spring, that is, an increase in the force opposing opening. In the solution according to the present invention, this increase does not occur, on the contrary the expansion of the gas in movement leads to a decrease in the force, thus making breathing less difficult;
- assurance of the closure of the valve 4 also during purging without pressure upstream.

The invention thus conceived is susceptible of numerous modifications and variants, all falling within the scope of the inventive concept that characterises it. Furthermore, all the details may be replaced with other technically equivalent elements. All the materials used, as well as the dimensions, may in practice be any whatsoever according to needs.

The invention claimed is:

1. A pressure-reducing system for a breathing apparatus comprising:

i) a supply conduit (2) for supplying a pressurised breathable gas;

ii) a suction mouthpiece (3) for a user to breathe in the breathable gas;

iii) a valve (4) interposed between the supply conduit (2) and the suction mouthpiece (3), the valve (4) in turn comprising:

an inlet (41) for the breathable gas coming from the supply conduit (2);

an outlet (42) for the breathable gas directed to the suction mouthpiece (3);

a shutter (43) that is movable between a first and a second position in which it respectively permits or prevents the passage of the breathable gas from the inlet (41) to the outlet (42);

a pressure balancing chamber (44), said shutter (43) being at least partially interposed between the inlet (41) of the valve (4) and the balancing chamber (44); the shutter (43) defining a passage (430) that places the inlet (41) of the valve (4) and the pressure balancing chamber (44) in fluid communication; a mechanical spring being absent between the shutter (43) and the pressure balancing chamber (44);

characterised in that the reducing system (1) comprises a movement system (5) for moving the pressure balancing chamber (44) towards the inlet (41) for the breathable gas to move the shutter (43) from the first position to the second position when at least one preset operating condition occurs.

2. The pressure-reducing system according to claim 1, characterised in that the movement system (5) comprises an elastic means (50) that pushes the pressure balancing chamber (44) towards the inlet (41) of the valve (4).

3. The pressure-reducing system according to claim 2, characterised in that the movement system (5) comprises a manual push actuator (51) for pushing the pressure balancing chamber (44) towards the inlet (41) of the valve (4); said actuator (51) being accessible by the user.

4. The pressure-reducing system according to claim 3, characterised in that said actuator (51) passes through the elastic means (50), the pressure balancing chamber (44) being movable towards the inlet (41) of the valve (4) both by means of the actuator (51) and by means of the elastic means (50).

5. The pressure-reducing system according to claim 1, characterised in that the movement system (5) comprises a manual push actuator (51) for pushing the pressure balancing chamber (44) towards the inlet (41) of the valve (4); said actuator (51) being accessible by the user.

6. The pressure-reducing system according to claim 1, characterised in that the movement system (5) for moving the pressure balancing chamber (44) comprises an auxiliary chamber (6); the auxiliary chamber (6) being placed in fluid communication with said balancing chamber (44) by means of a channel (60) having an outflow cross section of a size that is less than half of the outflow cross section of the passage (430).

7. The pressure-reducing system according to claim 1, characterised in that the movement system (5) for moving the pressure balancing chamber (44) comprises:

an auxiliary chamber (6);

a one-way valve (61) that permits the outflow from the pressure balancing chamber (44) to the auxiliary chamber (6);

said auxiliary chamber (6) comprising a vent valve (62) for venting pressure when a pressure threshold is exceeded.

8. The pressure-reducing system according to claim 1, characterised in that said shutter (43) extends between a first and a second end (431, 432); the first end (431) being nearer the inlet (41) of the valve (4) than the second end (432);

said second end (432) comprising a flat surface (433) that is orthogonal to a direction (45) of shifting of the shutter (43) between the first and the second position; on the flat surface (433) a groove (434) is obtained that extends at the passage (430).

9. The pressure-reducing system according to claim 1, characterised in that said pressure-reducing system comprises a seat (7) housing at least a first section (435) of the shutter (43) that is closer to the inlet (41); said first section (435) of the shutter (43) comprising a plurality of centring fins (436) that extend towards a wall (70) delimiting the seat (7) in order to align the shutter (43) correctly with the inlet (41) of the valve (4).

10. The pressure-reducing system according to claim 9, characterised in that the pressure-reducing system comprises a lever (8) for shifting the shutter (43) between the first and the second position;

said shutter (43) comprising:

a means (80) for interacting with said lever (8);

a flat zone (81) that extends, longitudinally, parallel to a preponderant direction (46) of extension of the shutter (43) and connecting the plurality of centring fins (436) and the means (80) for interacting with the lever (8).

11. The pressure-reducing system according to claim 1, characterised in that said pressure-reducing system comprises a means (90) for regulating a maximum stroke of the shutter (43); the regulating means comprising a pusher (901) intended to abut against a wall of the pressure balancing chamber in order to regulate/limit the position of maximum distancing of the pressure balancing chamber (44) from the inlet (41).

12. The pressure-reducing system according to claim 11, characterised in that the regulating means (90) comprises a control system (904) suitable for stably positioning the pusher (901) in a plurality of positions of maximum distancing of the pressure balancing chamber (44) from the inlet (41) of the valve (4).

13. A breathing system comprising:

a tank (9) of a breathable gas;

a first pressure reduction stage (91) located downstream of the tank (9);

a second pressure reduction stage (92) located downstream of the first stage (91) and comprising a pressure-reducing system (1) according to claim 1;

a tube (93) that connects the first stage (91) to the second stage (92) and inside which the gas moves.

14. A method for operating a pressure-reducing system according to claim 1 when a sufficient pressure drop occurs immediately upstream of the inlet (41); said method, when said pressure drop occurs, comprising the step of spontaneously pushing the balancing chamber (44) towards the inlet (41) for the breathable gas by means of the movement system (5), thereby causing the passage of the shutter (43) from the first position, in which it permits the outflow of the gas through the valve (4), to the second position in which the flow is interrupted.

* * * * *